United States Patent [19]

Lee

[11] Patent Number: 4,848,257

[45] Date of Patent: Jul. 18, 1989

[54] PRESSER FOOT WITH FABRIC GUIDE AND ROLLING ELEMENT

[76] Inventor: Kun-Jung Lee, No. 3 Alley 1, Lane 138, Chang An Street, Panchiao City, Taipei Hsien, Taiwan

[21] Appl. No.: 127,539

[22] Filed: Nov. 30, 1987

[51] Int. Cl.[4] ..... D05B 29/10

[52] U.S. Cl. ..... 112/235; 112/240

[58] Field of Search ..... 112/235, 240

[56] References Cited

U.S. PATENT DOCUMENTS

| | | | |
|---|---|---|---|
| 2,478,032 | 8/1943 | Wallsh | 112/235 |
| 2,478,073 | 8/1949 | Antonelli | 112/235 |
| 2,513,343 | 7/1950 | Maxson | 112/235 |
| 2,545,980 | 3/1951 | Vanadia et al. | 112/235 |
| 2,948,242 | 8/1960 | Shuman | 112/235 |
| 3,511,200 | 5/1970 | Howell | 112/235 |
| 3,726,243 | 4/1973 | Howell | 112/235 |
| 3,817,195 | 6/1974 | Meier | 112/235 |
| 4,278,039 | 7/1981 | Hanyu et al. | 112/240 |

FOREIGN PATENT DOCUMENTS

| | | | |
|---|---|---|---|
| 675841 | 7/1952 | United Kingdom | 112/235 |
| 729355 | 5/1955 | United Kingdom | 112/235 |

*Primary Examiner*—Andrew M. Falik

*Attorney, Agent, or Firm*—Lowe, Price, LeBlanc, Becker & Shur

[57] ABSTRACT

A presser foot that is adapted to extend forwardly upon attachment to a presser bar of a sewing machine that sews a fabric pressed under the presser foot includes a presser foot element that is pivotably attached to the presser bar and is biased pivotally with respect thereto by a spring, the element having a vertical slot with an open forward end and a rear end that is closed at a vertical needle-accommodating through aperture located ahead of a pivotal axis about which the presser foot pivots about the presser bar. The presser foot is formed with two recesses, one on each side of the forwardly open slot, each recess being longitudinally defined by outwardly extending flanges at each end, and a first pair of rolling elements that are rotatably supported coaxially by the presser foot element, one inside each of the two recesses about a common first axis that is disposed beneath the needle accommodating aperture, so that the rolling elements press on a fabric being sewn thereunder by the needle. In another aspect of the invention, the presser foot element is formed to have only one recess along a longitudinal side thereof, the recess being closeable by a securely attachable but readily detachable longitudinally extending plate.

13 Claims, 3 Drawing Sheets

PRESSER FOOT WITH FABRIC GUIDE AND ROLLING ELEMENT

FIELD OF THE INVENTION

The present invention relates to a presser foot for a sewing machine, and more particularly to one which has a fabric guide and at least one rolling element for reducing friction between the press foot and the fabric being guided and sewn thereunder.

BACKGROUND OF THE PRIOR ART

In this art, when a feed dog automatically moves a fabric under a needle, the fabric is pressed by a presser foot just before it is sewn. Because friction exists between the fabric and the presser foot, a problem often takes place in that the fabric cannot be moved smoothly. To overcome this problem, a slippery material such as Teflon (TM) is attached to the bottom surface of the presser foot. Alternatively, a lubricating oil is applied to the bottom surface of the presser foot. Although the friction between the presser foot and the fabric is reduced by these methods, the cost of sewing the fabric is largely increased due to the Teflon (TM) or the lubricating oil added. Also, because a conventional sewing machine lacks a guide for the fabric, the lines along which the fabric is to be stitched must be marked on the fabric prior to stitching. Furthermore, if the fabric is sewn by an unskilled worker, the stitched lines may deviate from the marked lines.

SUMMARY OF THE INVENTION

It is, therefore, an object of the present invention to provide a presser foot under which the fabric can be moved smoothly.

It is another object of the present invention to provide a presser foot whereby the fabric can be stitched accurately.

According to the present invention, a presser foot for a sewing machine comprises at least one rolling element mounted rollably on a bottom surface thereof for reducing friction between the presser foot and a fabric being sewn, and a guide provided on the bottom surface of the presser foot for guiding an edge of the fabric to move along a guide. In the preferred embodiment, the rolling element is a roller, while the guide is a rib.

BRIEF DESCRIPTION OF THE DRAWINGS

Other features and advantages of the present invention will become apparent from the following detailed description of the preferred embodiments of the present invention with reference to the accompanying drawings in which.

DETAILED DESCRIPTION OF THE PREFERRED EMBODIMENTS

Figure 1:
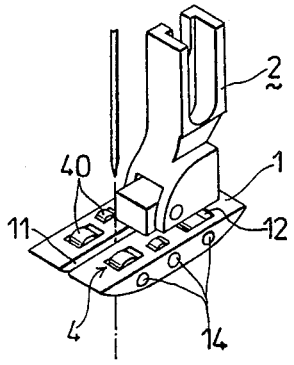
FIG. 1 is a perspective assembled view showing a presser foot according to a first embodiment of the present invention.
Figure 2:
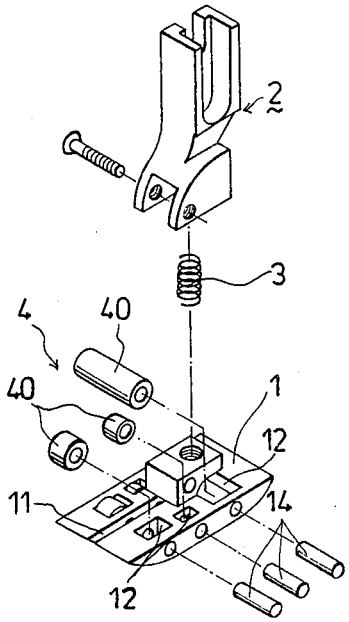
FIG. 2 is a partially exploded perspective view showing the presser foot according to the first embodiment of the present invention.

Referring to FIGS. 1 and 2, there is shown an assembly of a presser foot 1 and a presser bar 2, which is used for a sewing machine. A needle hole 11 for a needle 11 is formed in the presser foot 1 so that the fabric being sewn can be pressed by the presser foot 1 on both sides of the stitching line. A spring 3 is mounted between the presser foot 1 and the presser bar 2 in a known manner for biasing the presser foot 1 to move away from the presser bar 2.

As best seen from FIG. 2, the presser foot 1 is provided with five rollers 4 each of which includes a pin 14 fixed on the presser foot 1, and a ring 40 sleeved rotatably on the pin 14. The presser foot 1 is formed with five rectangular holes 12 in each of which one of the rings 40 is mounted. In this figure, three pins 14 and three rings 40 are illustrated as removed from the presser foot 1. It can be understood that the rollers 4 render the fabric being sewn movable smoothly under the presser foot 1.

Figure 3:
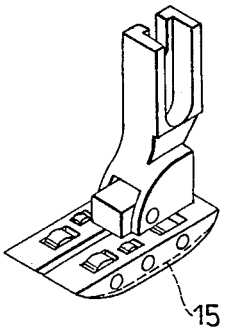
FIG. 3 is a perspective assembled view showing a presser foot according to a second embodiment of the present invention.
Figure 4:
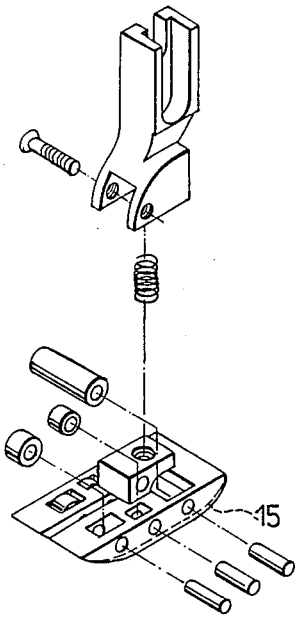
FIG. 4 is a partially exploded perspective view showing the presser foot according to the second embodiment of the present invention.

Referring to FIGS. 3 and 4, there is shown a second embodiment of the present invention. Unlike the first embodiment shown in FIGS. 1 and 2, the presser foot is formed with a rib 15 along the length of its bottom surface. When stitching a fabric, the edge of the fabric to be stitched is abutted against the rib 15 so that the fabric can be guided. With the rib 15 formed on the bottom surface of the presser foot, the fabric can be stitched accurately, even by an unskilled worker.

Figure 5:
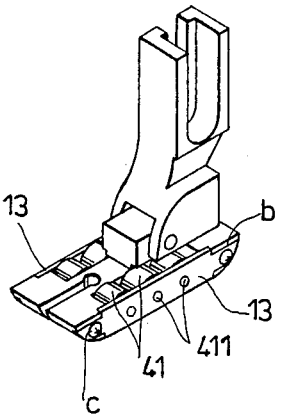
FIG. 5 is a perspective assembled view showing a presser foot according to a third embodiment of the present invention.
Figure 6:
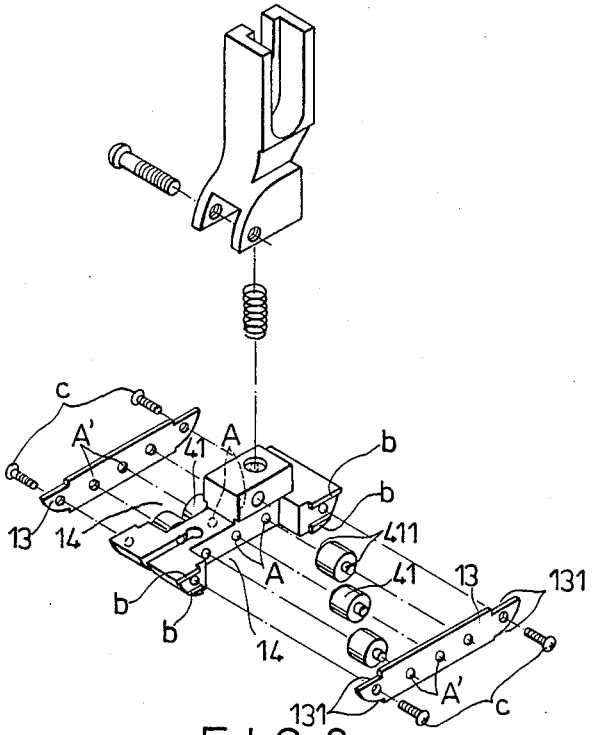
FIG. 6 is a partially exploded perspective view showing the presser foot according to the third embodiment of the present invention.

Other methods for mounting the rollers on the presser foot may be utilized. Referring to FIGS. 5 and 6, in a third embodiment of the invention each of the rollers is formed of a cylinder 41 having a rotating shaft 411 which is journalled on the presser foot. A slot 100 with an open forward end is provided so as to end in a vertical needle-accommodating hole 102. Two recesses 14 are respectively formed in both of the long sides of the presser foot are on either side of slot 100 and hole 102. Two positioning plates 13 are respectively screwed to both long sides of the presser foot by screws C. The walls of the presser foot defining the recesses 14 are formed with circular holes A therein. Oppositely, the positioning plates 13 are formed with circular holes A' for cooperating with the circular holes A formed in the presser foot to mount the rotating shafts 411 of the cylinders 41 rotatably on the presser foot. The presser foot is provided with four outward flanges b, one each on the four corners of each side surface thereof. Each of the positioning plates 13 is also formed on each corner thereof with a notch 131 which is aligned with one of the flanges b for positioning the positioning plate 13 relative to the presser foot, so that it is convenient to screw the positioning plate 13 onto the presser foot. The bottom surfaces of the presser foot and the positioning plates are positioned at the same level.

Figure 7:
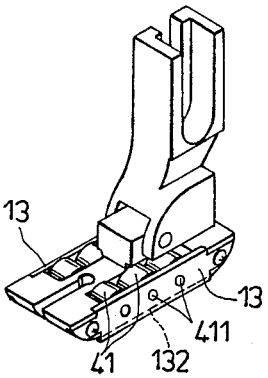
FIG. 7 is an assembled perspective view showing a presser foot according to a fourth embodiment of the present invention.

If desired, according to a fourth embodiment of the invention as illustrated in FIG. 7, each of the positioning plates 13 may have a projecting bottom side 132 which extends downwardly to a level slightly lower than that of the bottom surface of the presser foot, thereby functioning in the same manner as the rib 15 of the second embodiment shown in FIGS. 3 and 4, i.e., to guide an edge of the fabric.

Figure 8:
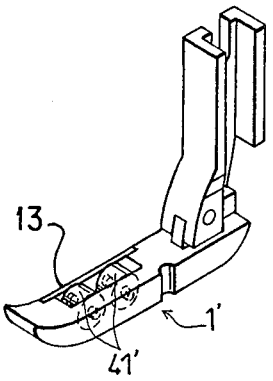
FIG. 8 is an assembled perspective view showing a presser foot according to a fifth embodiment of the present invention.

Certainly, the rollers 40 may be mounted on various types of presser feet for sewing machines. For example, as illustrated in a fifth embodiment per FIG. 8, two rollers 41' are mounted rotatably on a single presser foot 1' with a recess and a positioning plate as in the previously described embodiments, which is designed to press over the fabric being sewn on only one side of the stitching line. Note that a vertically oriented recess 104 is provided on one side of the presser foot to accommodate the needle so that the line of stitching is close to and along an edge of the presser foot.

With the present invention thus explained, it is apparent that various modifications and variations can be made without departing from the scope and spirit of the present invention. It is therefore intended that the present invention be limited only as indicated in the appended claims.

I claim

1. A presser foot, adapted to extend forwardly upon attachment to a presser bar of a sewing machine having a needle that sews a fabric pressed under the presser foot, comprising:

a presser foot element, formed with an attachment portion pivotably attachable to said presser bar and pivotally biased with respect thereto by a spring, said presser foot element having a vertical slot with an open forward end and a rear end closed at a vertical needle-accommodating through aperture located forwardly of a pivotal axis about which said presser foot pivots about said presser bar and two recesses one on each side of said slot and each longitudinally defined by outwardly extending flanges at each end; and a first pair of rolling elements rotatably supported coaxially by said presser foot element, one inside each of said two recesses with a common first axis of rotation disposed beneath said needle-accommodating aperture, said rolling elements being of a shape and size such that they rollingly press on a fabric being sewn thereunder by said needle.

2. A presser foot according to claim 1, further comprising:

a pair of positioning plates formed to attach one on the outside of each of said recesses to corresponding ones of said flanges and to rotatably support said rolling elements.

3. A presser foot according to claim 2, wherein:

said flanges are formed to facilitate accurate location of said plates and to enable secure but readily detachable attachment thereof.

4. A presser foot according to claim 2, wherein:

one of said positioning plates is formed to extend an edge portion below a lower surface of said presser foot element to guide said fabric.

5. A presser foot according to claim 2, wherein:

each of said rolling elements comprises a generally cylindrical roller.

6. A presser foot according to claim 5, wherein:

each of said rollers comprises a rotating shaft journalled to said presser foot and a corresponding one of said positioning plates.

7. A presser foot according to claim 1, further comprising:

at least a second pair of rolling elements, rotatably supported coaxially by said presser foot element, one inside each of said two recesses about a common second axis of rotation located rearwardly of said pivotal axis, said second pair of rolling elements also being of a shape and size to rollingly press on a fabric sewed under said presser foot element.

8. A presser foot according to claim 7, further comprising:

a pair of positioning plates formed to attach one on the outside of each of said recesses to said flanges and to rotatably support said rolling elements.

9. A presser foot according to claim 7, wherein:

each of said rolling elements comprises a generally cylindrical roller.

10. A presser foot according to claim 9, wherein:

each of said rollers comprises a rotating shaft journalled to said pressure foot and a corresponding one of said positioning plates.

11. A presser foot according to claim 8, wherein:

said flanges are formed to facilitate accurate location of said plates and to enable secure but readily detachable attachment thereof.

12. A presser foot according to claim 8, wherein:

one of said positioning plates is formed to extend an edge portion below a lower surface of said presser foot element to guide said fabric.

13. A presser foot, adapted to extend forwardly, upon attachment to a presser bar of a sewing machine having a needle that sews a fabric being pressed under the presser foot, comprising:

a presser foot element, formed with an attachment pivotably attachable to said presser bar and also formed to have a longitudinal first recess closeable by a securely attachable but readily detachable longitudinally extending plate to define an elongated longitudinally extending openable aperture in said presser foot element;

a pair of rolling elements rotatably supported within said elongate aperture about respective horizontal axes both located forwardly of a pivotal axis of said pivotable attachment between said presser foot element and said presser bar, said rolling elements being shaped, sized and disposed so as to rollingly press on a fabric passed thereunder to be sewn by said needle; and said presser foot element is formed at a longitudinal side thereof, on a side opposite to said first recess, with a vertically oriented recess between said pivot axis and the nearest one of said pair of rolling elements to accommodate said needle, whereby said fabric is pressed by said rolling elements substantially only on one side of a stitching line along which said needle sews said fabric.

* * * * *